US007874295B2

(12) United States Patent
Kageyama et al.

(10) Patent No.: US 7,874,295 B2
(45) Date of Patent: Jan. 25, 2011

(54) SHREDDED TOBACCO MATERIAL FEEDER OF A CIGARETTE MANUFACTURING APPARATUS

(75) Inventors: Tetsuo Kageyama, Tokyo (JP); Naoto Murase, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 335 days.

(21) Appl. No.: 12/222,644

(22) Filed: Aug. 13, 2008

(65) Prior Publication Data

US 2008/0314396 A1 Dec. 25, 2008

(51) Int. Cl.
*A24C 5/18* (2006.01)

(52) U.S. Cl. ..... 131/84.1; 131/84.3; 131/108; 131/109.2; 131/110

(58) Field of Classification Search ..... None
See application file for complete search history.

(56) References Cited

U.S. PATENT DOCUMENTS

| | | | | |
|---|---|---|---|---|
| 3,138,163 | A * | 6/1964 | Fischer Ffoulkes | 131/84.3 |
| 5,148,816 | A * | 9/1992 | Heitmann | 131/84.1 |
| 5,267,576 | A * | 12/1993 | Heitmann | 131/84.1 |
| 2004/0055612 | A1 | 3/2004 | Kubo et al. | |
| 2005/0087199 | A1 | 4/2005 | Stuber | |
| 2006/0096606 | A1 | 5/2006 | Focke et al. | |

FOREIGN PATENT DOCUMENTS

| | | | |
|---|---|---|---|
| JP | 3-168077 | A | 7/1991 |
| JP | 4-320674 | A | 11/1992 |
| JP | 7-184625 | A | 7/1995 |
| JP | 3090624 | B2 | 7/2000 |
| JP | 2002-58463 | A | 2/2002 |
| JP | 2005-124576 | A | 5/2005 |
| RU | 96118363 | A | 11/1998 |
| RU | 2 191 528 | C2 | 10/2002 |
| SU | 191386 | A1 | 1/1967 |
| SU | 449463 | A3 | 11/1974 |
| UA | 50815-02 | | 11/2002 |
| UA | 53621 | C2 | 2/2003 |
| WO | WO 02/076245 | A1 | 10/2002 |
| WO | WO 2004/039182 | A2 | 5/2004 |

* cited by examiner

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

A shredded tobacco material feeder of a cigarette manufacturing apparatus has a reservoir (2) of shredded tobacco material; a first separation chamber (20) and a second separation path (28) for dividing the shredded tobacco material into normal particles and separation material having larger particle sizes than the normal particles in a process when the shredded tobacco material is fed from the reservoir (2) toward a tobacco band of the apparatus; a sieve conveyor (34) for receiving and transferring the separation material discharged from the second separation path (28), and separating the separation material into large particles having large particle sizes and medium particles having smaller particle sizes than the large particles; and a cyclone (48) for receiving the medium particles from the sieve conveyor (34), the cyclone (48) separating returnable components corresponding to the normal particles from the medium particles, and returning the returnable components to the reservoir (2).

9 Claims, 4 Drawing Sheets

SHREDDED TOBACCO MATERIAL FEEDER OF A CIGARETTE MANUFACTURING APPARATUS

TECHNICAL FIELD

The present invention relates to a feeder for feeding shredded tobacco material to a manufacturing apparatus which manufactures cigarette rods.

BACKGROUND ART

A feeder of this type is disclosed, for example, in Patent Document 1. This well-known feeder feeds shredded tobacco material toward a tobacco band of a cigarette manufacturing apparatus. Then, the shredded tobacco material is subjected to first and second winnowing processes. The object of the winnowing processes is to separate the shredded tobacco material into large particles having large sizes and normal particles having sizes that are smaller than the large particles and fall within a desired range, and then to remove the large particles from the shredded tobacco material. Accordingly, the tobacco band is fed with the normal particles contained in the shredded tobacco material.

The large particles have more weight than the normal particles, and contain stems and midribs, which are produced due to the defective shredding of tobacco material, and also include a portion of butterfly wing-shaped tobacco leaves, etc.

Patent Document 1: International Publication No. WO2002/076245

DISCLOSURE OF THE INVENTION

Problem to be Solved by the Invention

It is difficult to divide shredded tobacco material strictly into normal particles and large particles by the first and second winnowing processes. The divided large particles are therefore mixed with a great amount of normal particles. After the divided large particles are collected by a central dust collector, the normal particles contained in the collected large particles are extracted from the large particles as returnable components. The returnable components are used as normal particles for manufacturing cigarette rods. The large particles from which the returnable components are removed are used as material for a reconstructed tobacco sheet.

A cigarette factory is installed with a large number of apparatuses for manufacturing cigarette rods of different brands. These apparatuses are connected to a single central dust connector. The central dust collector collects the large particles of shredded tobacco material of different brands. In order to retain the flavor and taste of cigarettes of each brand, an amount of the returnable components usable as normal particles per cigarette has to be small. For this reason, the stock of the returnable components grows larger.

It is an object of the invention to provide a shredded tobacco material feeder of a cigarette manufacturing apparatus, which improves a usage rate of the returnable components without ruining the flavor and taste of cigarettes.

Means of Solving the Problem

In order to achieve the object, a feeder according to the invention comprises a feeding path for feeding shredded tobacco material toward a tobacco band of a cigarette manufacturing apparatus; separation means for dividing the shredded tobacco material into normal particles having desired particle sizes and separation material having larger particle sizes than the normal particles in a feeding process of the shredded tobacco material; and a collecting path for receiving the separation material from the separation means, and transferring the separation material toward a central dust collector. The separation means includes a sieve conveyor for receiving and transferring the separation material, the sieve conveyor dividing the separation material into large particles having large particle sizes and medium particles having smaller particle sizes than the large particles in a transfer process of the separation material, and returning the large particles to the collecting path; a returning path for receiving the medium particles from the sieve conveyer, and returning the medium particles to the feeding path; and a separator interposed in the reduction path, for dividing the medium particles into returnable components corresponding to the normal particles and collected components other than the returnable components, and discharging the collected components into the collecting path.

With this feeder, in the process when the separation material that has been separated from the shredded tobacco material by the separation means is collected by the central dust collector, the returnable components are extracted from the separation material by the sieve conveyor and the separator. The extracted returnable components are returned to the feeding path of the same feeder.

More specifically, a sieve of the sieve conveyor may include a sieve face and a large number of sieve meshes distributed in the sieve face and protruding from the sieve face, the sieve meshes having openings that face a direction of transferring the separation material and bottom faces that extend from the openings toward the upstream side in the transfer direction and are inclined downward.

In this case, the sieve conveyor includes the sieve and an oscillating source. Preferably, the oscillating source oscillates the sieve so that the sieve moves more slowly in backward speed than in forward speed as viewed in the transfer direction of the separation material. To be concrete, the oscillating source may include a pair of oscillating cylinders.

Preferably, each of the sieve meshes has a raised portion for forming the opening, and the raised portion is formed into a triangle that is tapered from the opening toward the upstream side in the transfer direction.

Preferably, the sieve meshes are distributed to form a plurality of lines extending parallel to each other in the transfer direction, and the sieve meshes of each line are displaced from the respective sieve meshes of an adjacent line in terms of the transfer direction. In this case, the sieve meshes of the same line may be continuously formed in the transfer direction.

The sieve may include an upstream section having given opening ratio as viewed in the transfer direction and a downstream section having higher opening ratio than the upstream section.

The sieve conveyor transfers the separation material that the sieve conveyor has received. In this transfer process, the separation material is reliably separated into the large particles and the medium particles according to shapes of the sieve meshes of the sieve conveyor and speed difference between the forward speed and the backward speed of the sieve. The separated medium particles fall from the sieve, whereas the large particles are carried on the sieve. Subsequently, the separator further separates the medium particles into the returnable components corresponding to the normal particles and the collected components.

The returning path is connected to the feeding path in the upstream of the separation means. Therefore, returnable shreds that have been returned to the feeding path are subjected again to a separation process carried out by the separation means.

TECHNICAL ADVANTAGES OF THE INVENTION

The shred tobacco material feeder of a cigarette manufacturing apparatus extracts the returnable components from the separation material before the separation material that has been separated from the shred tobacco material is collected by the central dust collector, and then returns the returnable components to the feeding path of the shred tobacco material. It is therefore possible to improve a usage rate of the returnable components without ruining the flavor and taste of cigarettes that are manufactured by a cigarette manufacturing apparatus.

The sieve of the sieve conveyor is prevented from being clogged with the large particles in the sieve meshes, and functions to smoothly and reliably separate the separation material into the large particles and the medium particles.

To repeatedly subject the returnable components to the separation process using the separation means highly contributes to a quality improvement of the manufactured cigarettes.

BEST MODE OF CARRYING OUT THE INVENTION

Figure 1:
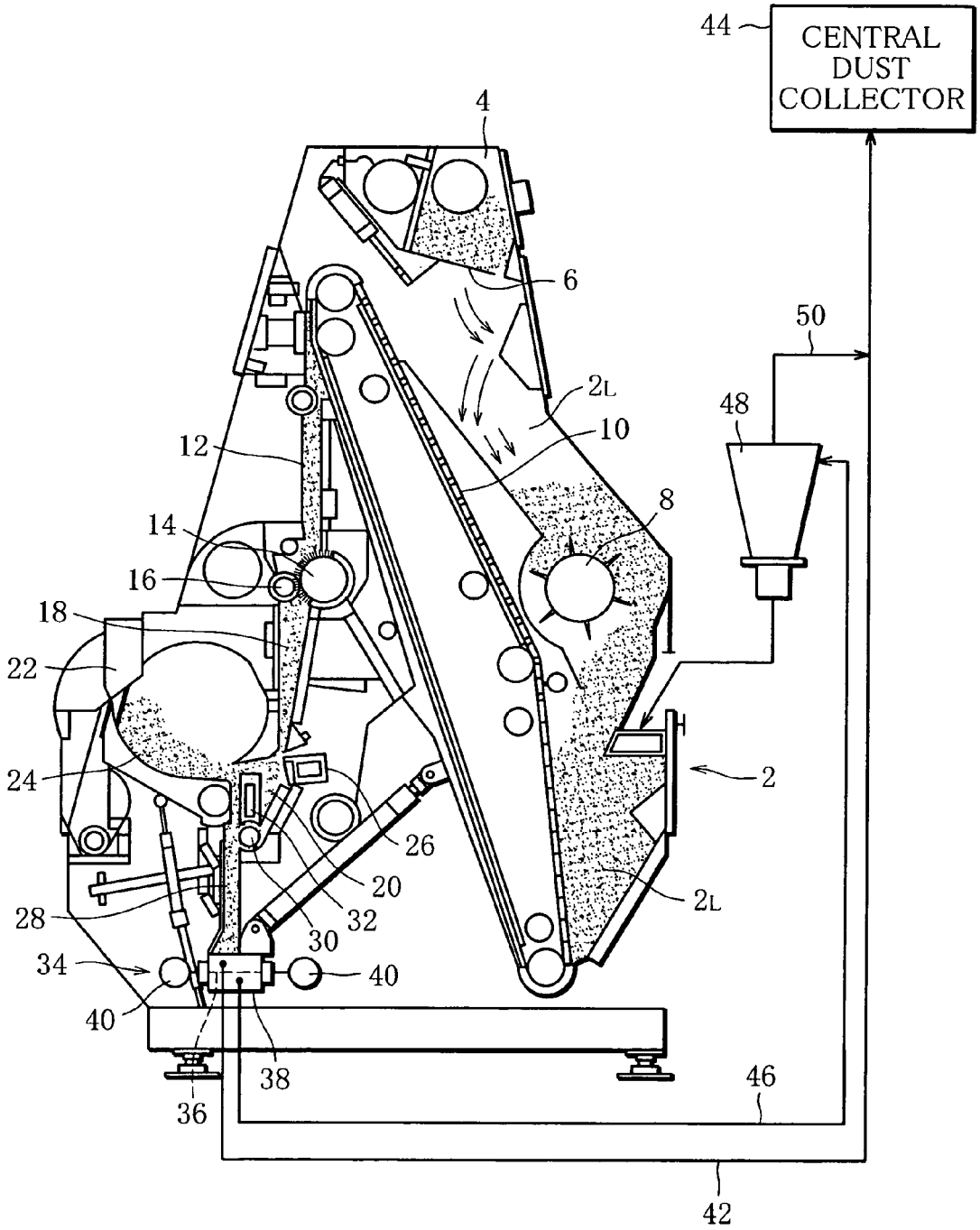
FIG. 1 is a schematic sectional view of a shredded tobacco material feeder.

FIG. 1 shows a shredded tobacco material feeder for a cigarette manufacturing apparatus.

The feeder has a reservoir 2 of shredded tobacco material. The reservoir 2 is situated in the rear of the feeder (on the right side as viewed in FIG. 1). Above the reservoir 2 is located a feed chamber 4. The feed chamber 4 is connected to a central distributor (not shown) of the shredded tobacco material through an air tube. The central distributor is capable of feeding the shredded tobacco material to the feed chamber 4 together with air flow through the air tube. The feed chamber 4 has an openable and closable flap 6 in the bottom thereof. When the flap 6 is opened, the shredded tobacco material in the feed chamber 4 is fallen from the feed chamber 4 into the reservoir 2.

In the reservoir 2, a measuring roller 8 is rotatably installed. The reservoir 2 is divided by the measuring roller 8 into an upper chamber $\mathbf{2}_U$ and a lower chamber $\mathbf{2}_L$ When the measuring roller 8 is rotated, the shredded tobacco material is fed from the upper chamber $\mathbf{2}_U$ to the lower chamber $\mathbf{2}_L$ in the reservoir 2. A feed amount is determined by a rotational speed of the measuring roller 8. Therefore, amount of the shredded tobacco material stored in the lower chamber $\mathbf{2}_L$ is adjustable by varying the rotational speed of the measuring roller 8.

On the left side of the reservoir 2, an elevator conveyer 10 is located adjacent to the reservoir 2. The elevator conveyor 10 upwardly extends from the bottom of the lower chamber $\mathbf{2}_L$ of the reservoir 2. The elevator conveyor 10 has an endless carrier belt. The carrier belt forms a left side wall of the reservoir 2 as viewed in FIG. 1. The carrier belt has a large number of teeth arranged at regular intervals in a running direction thereof. When the carrier belt of the elevator conveyor 10 is activated to run, the teeth carry the shredded tobacco material contained in the lower chamber $\mathbf{2}_L$ upward while the teeth bite into the shredded tobacco material.

A bulking chute 12 is connected to and downwardly extends from an upper end of the elevator conveyor 10. The bulking chute 12 receives the shredded tobacco material from the upper end of the elevator conveyor 10. Then, the shredded tobacco material falls through the bulking chute 12.

In a lower end of the bulking chute 12, a needle roller 14 and a picker roller 16 are rotatably situated. A gravity chute 18 downwardly extends from the needle roller 14 and the picker roller 16.

The shredded tobacco material that has been fed into the bulking chute 12 is accumulated above the needle roller 14 and the picker roller 16. The shredded tobacco material accumulated in the chute 12 passes through between the needle roller 14 and the picker roller 16 as the rollers 14 and 16 rotates, and then is fed into the gravity chute 18. Again, a feed amount of the shredded tobacco material into the gravity chute 18 is adjustable by varying a rotational speed of the rollers 14 and 16.

A primary separation chamber 20 is situated right under a lower end of the gravity chute 18. The primary separation chamber 20 has an upper end connected with a fluidized bed trough 24. The fluidized bed trough 24 extends from an upper end of the primary separation chamber 20 to a suction chamber 22 of the cigarette manufacturing apparatus. In the suction chamber 22, there is disposed a suction band, or tobacco band (not shown). The tobacco band extends to reach a wrapping section (not shown) of the cigarette manufacturing apparatus. The wrapping section receives the shredded tobacco material, which is carried by the tobacco band, on a paper web and wraps the shredded tobacco material in the paper web, to thereby form a tobacco rod.

A primary air jet 26 is located on the upper end of the primary separation chamber 20. The primary air jet 26 is directed toward the fluidized bed trough 24. The primary air jet 26 produces a primary air jet flow. The primary air jet flow runs across the upper end of the primary separation chamber 20 and enters into the fluidized bed trough 24.

When the shredded tobacco that has fallen from the gravity chute 18 into the primary separation chamber 20 is exposed to the primary air jet flow, the normal particles contained in the shredded tobacco material, which have particle sizes within a desired range, are deflected toward the fluidized bed trough 24 by the primary air jet flow. At the same time, the rest of the shredded tobacco material passes through the primary air jet flow and further falls through the primary separation chamber 20 as separation material. The separation material chiefly contains the large particles, but partially contains the normal particles as well. Therefore, the primary air jet flow performs a primary winnowing process for the shredded tobacco material. The winnowing process here divides the shredded tobacco material into the normal particles and the separation material containing the normal particles and the large particles.

A secondary separation path 28 is disposed near the primary separation chamber 20. The secondary separation path 28 extends in a vertical direction, and has an upper end that opens in the bottom of the fluidized bed trough 24 at an inlet portion of the fluidized bed trough 24. The primary separation chamber 20 has a lower end connected to the secondary separation path 28 through an air locker 30.

The secondary separation path 28 is installed with a secondary air jet 32. The secondary air locker 32 is located above the air locker 30. The secondary air jet 32 upwardly injects a secondary air jet flow into the secondary separation path 28. The secondary air jet flow produces an ascending air current in the secondary separation path 28.

When the separation material is discharged from the lower end of the primary separation chamber 20 through the air locker 30 into the secondary separation path 28, a part of the normal particles contained in the separation material is blown up with the ascending air current in the secondary separation path 28 to be fed to the fluidized bed trough 24. The rest of the separation material falls through the secondary separation path 28. In this manner, a secondary winnowing process is performed to the separation material by the ascending air current in the secondary separation path 28.

The fluidized bed trough 24 further includes a plurality of air jet lines (not shown). The air jet lines are arranged at intervals in a flowing direction of the primary air jet flow. The air jet lines inject air toward the tobacco band. The air injection carries the normal particles of the shredded tobacco material, which have been fed onto the fluidized bed trough 24 with the primary air jet flow, to the tobacco band along the fluidized bed trough 24. The normal particles are then sucked onto a lower face of the tobacco band in layers. The layered normal particles sucked onto the tobacco band are subsequently fed to the wrapping section of the manufacturing apparatus. As described above, a tobacco rod is produced from the normal particles of the shredded tobacco material and the paper web in the wrapping section. The tobacco rod is cut into pieces of given length, whereby cigarette rods are obtained.

As is apparent from the foregoing description, the feeder includes the feeding path for the shredded tobacco material, which extends from the feed chamber 4 to the suction chamber 22. In the middle of the feeding path, the shredded tobacco material is subjected to the primary and secondary winnowing processes.

Right under the secondary separation path 28, there is disposed an oscillation-type sieve conveyor 34. The sieve conveyor 34 receives separated shreds that have fallen from a lower end of the secondary separation path 28. More specifically, the sieve conveyor 34 has a double-layered carrier faces. An upper carrier face is formed of an oscillating sieve 36, and a lower carrier face is formed of an oscillation transfer face 38.

Referring to FIG. 1, reference numeral 40 denotes a pair of oscillating cylinders serving as an oscillating source of the sieve conveyor 34. With respect to the operation of the oscillating cylinders 40, expansion and contraction speeds of the oscillating cylinders 40 are arbitrarily variable.

The separation material that has been fallen from the lower end of the secondary separation path 28 is first received by the oscillating sieve 36 of the sieve conveyor 34, and then transferred on the oscillating sieve 36. In this transfer process, among the separation material, the large particles having large particle sizes are left on the oscillating sieve 36, whereas the medium particles having smaller particle sizes than the large particles pass through sieve meshes of the oscillating sieve 36 and are received on the oscillation transfer face 38 located beneath the oscillating sieve 36. As a result, the large particles and the medium particles are separated from each other and placed on the oscillating sieve 36 and the oscillation transfer face 38, respectively, and are carried in the same direction. To be specific, the large particles have particle sizes of approximately 3.3 mm or more.

A collecting path 42 extends from a terminal end of the oscillating sieve 36, and is connected to a central dust collector 44. The large particles are discharged from the oscillating sieve 36 into the collecting path 42, and carried through the collecting path 42 toward the central dust collector 44 along with air flow to be collected in the central dust collector 44.

A returning path 46 extends from the oscillation transfer face 38 and is connected to the reservoir 2. A cyclone 48 functioning as a separator is interposed in the returning path 46. The cyclone 48 is connected to the collecting path 42 through a discharge path 50. The medium particles are discharged from the oscillation transfer face 38 into the returning path 46, and carried through the returning path 46 along with air flow to be fed to the cyclone 48.

When the medium particles are fed into the cyclone 48, the cyclone 48 separates shredded tobacco of sizes corresponding to the normal particles from the medium particles as returnable components. The returnable components are returned from the cyclone 48 through the returning path 46 to the reservoir 2. More specifically, the returnable components have particle sizes of approximately 1.8 mm, and the normal particles approximately 2.5 mm.

Since the shredded tobacco as returnable components is a part of the shredded tobacco material in the reservoir 2, the returnable components have the same flavor and taste as the shredded tobacco material. Therefore, even if the returnable components are returned into the reservoir 2, there is no adverse effect on cigarette rods, or the flavor and taste of cigarettes.

Micro-particles (fine powder of shredded tobacco) having smaller particle sizes than the returnable components are collected as collected components from the cyclone 48 through the discharge path 50 and the collecting path 42 into the central dust collector 44.

Figure 2:
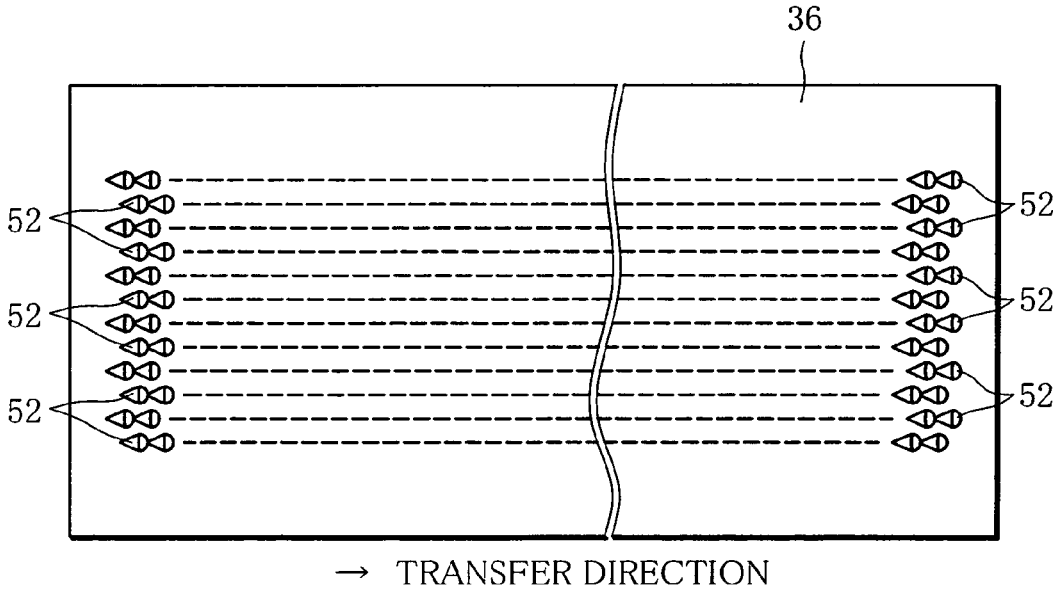
FIG. 2 is a plan view showing an oscillating sieve of a first embodiment.

FIG. 2 specifically shows the oscillating sieve 36 of a first embodiment.

The oscillating sieve 36 is a sieve of a so-called nose-hole type and has a large number of sieve meshes 52. The sieve meshes 52 are uniformly distributed all over the oscillating sieve 36. More specifically, the sieve meshes 52 are distributed to form a plurality of lines. The lines of the sieve meshes 52 extend in a transfer direction of the separation material. A distribution pitch of the sieve meshes in each line differs from that of the sieve meshes of an adjacent line by a half pitch. The sieve meshes 52 in the same line are continuously arranged in the transfer direction.

Figure 3:
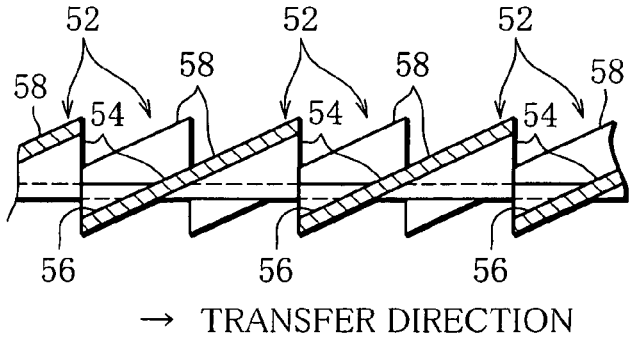
FIG. 3 is a longitudinal section showing sieve meshes of the oscillating sieve shown in FIG. 2.
Figure 4:
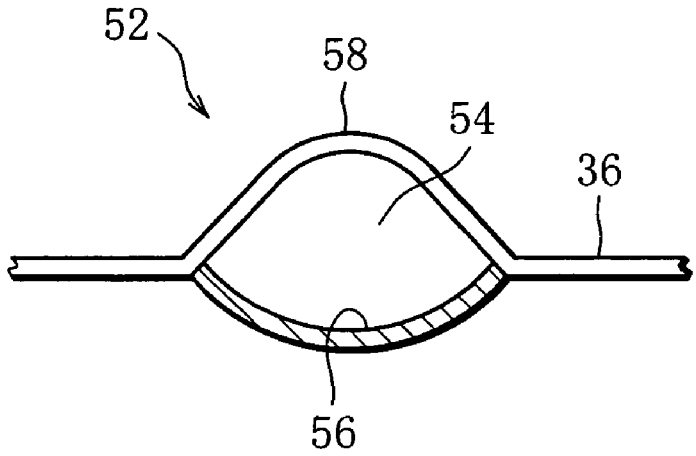
FIG. 4 is a cross section of the sieve meshes shown in FIG. 3.
Figure 5:
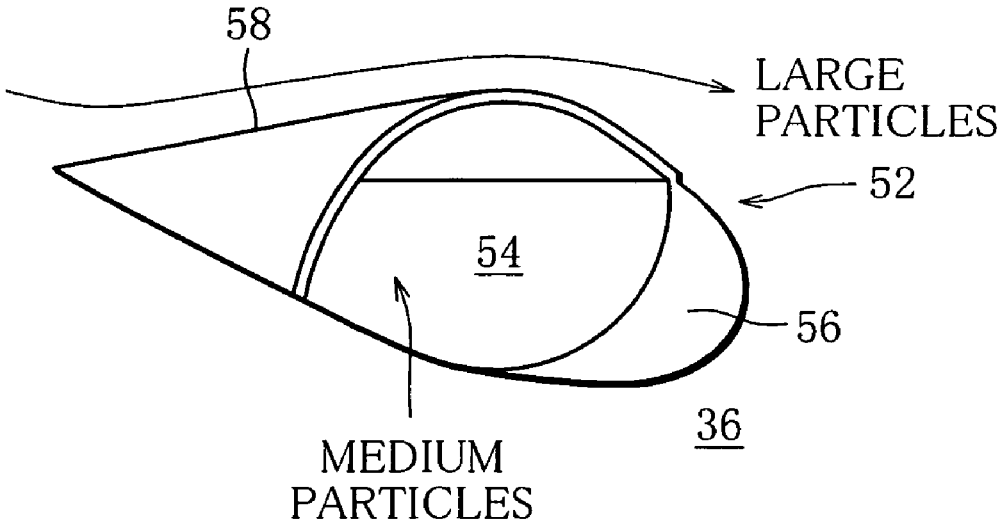
FIG. 5 is a perspective view of the sieve meshes shown in FIG. 3.

As is apparent from FIGS. 3 to 5, each of the sieve meshes 52 has an opening 54 that is protruding from a sieve face of the oscillating sieve 36. The opening 54 has a flat oval shape and is downwardly inclined with respect to the transfer direction. Each of the sieve meshes 52 has a bottom face 56, which extends obliquely downward from a lower edge of the opening 54 toward an upstream side as viewed in the transfer direction. A cross section of the bottom face 56 is not flat but is in a convex arc shape downward.

In order for the opening 54 to be formed, each of the sieve meshes 52 has a raised wall 58 in the shape of a substantial triangle in a planar view. The raised portion 58 is tapered toward the upstream side as viewed in the transfer direction, and has a cross section in the shape of a spray arc that protrudes in an upward direction (see FIG. 5).

The sieve meshes 52 have a size that is properly determined according to sizes of the large particles so that the separation material may be divided into the large particles and the medium particles as stated above. More specifically, the sieve meshes 52 extending in the transfer direction have greater length than the large particles. Maximum opening width and height of the opening 54 and maximum length of the bottom face 56 are set smaller than lengths of the large particles. For instance, the maximum opening width and height of the opening 54 are 8 mm and 3.5 mm, respectively.

In order to prevent the sieve meshes 52 of the oscillating sieve 36 in the sieve conveyor 34 from being clogged with the large particles, as to an excitation speed of the oscillating sieve 36, that is, a forward speed of the oscillating sieve 36 moving in the transfer direction and a backward speed of the oscillating sieve 36 moving in the opposite direction to the transfer direction, the backward speed is set lower than the forward speed. The excitation speed can be easily realized by differentiating the expansion speed and the contraction speed of the oscillating cylinders 40. Needless to say, an excitation stroke and an excitation direction of the oscillating cylinders 40 are also properly adjusted.

As described above, each of the sieve meshes 52 has the raised portion 58 protruding from the oscillating sieve 36 and the opening 54, and the sieve meshes 52 of each line face in the transfer direction of the separation material. The separation material on the oscillating sieve 36 is carried by oscillation of the oscillating sieve 36. In this process, even if the separation material repeatedly bounces up and down on the oscillating sieve 36, because of the above-mentioned size of the sieve meshes 52, the large particles contained in the separation material remain on the oscillating sieve 36 in a state caught in between the adjacent sieve meshes 52. The large particles in the separation material are accordingly transferred, overleaping the sieve meshes 52 so as not to pass through the openings 54 of the sieve meshes 52.

The medium particles contained in the separation material, which are smaller than the large particles, fall down onto the bottom faces 56 of the sieve meshes 52. As mentioned above, the bottom faces 56 are downwardly inclined in the backward direction of the oscillating sieve 36, and the backward speed of the oscillating sieve 36 is lower than the forward speed thereof. For this reason, during the backward movement of the oscillating sieve 36, the medium particles on the bottom faces 56 are pushed out by the bottom faces 56 toward the upstream side in the transfer direction, and led to lower edges of the bottom faces 56, or into the openings 54. During the subsequent forward movement of the oscillating sieve 36, the bottom faces 56 move in the transfer direction so as to escape from the medium particles. As a result, the medium particles on the bottom faces 56 smoothly pass through the openings 54 of the sieve meshes 52, and then fall down from the oscillating sieve 36 onto the oscillation transfer face 38 located under the oscillating sieve 36. The separation material is surely separated into the large and medium particles without clogging the sieve meshes 52 of the sieve conveyor 34.

A separation process using the sieve conveyor 34 provides the large particles with particle sizes of approximately 3.3 mm or more and returnable shreds with particle sizes of approximately 1.8 mm. In this connection, regular shreds have particle sizes of approximately 2.5 mm. To be more specific, the maximum opening width and height of the opening 54 are 8 mm and 3.5 mm, respectively.

The invention is not limited to the one embodiment and may be modified in various ways.

For instance, the sieve meshes 52 of the oscillating sieve 36 may be arbitrarily modified in specific shape and arrangement as long as the sieve meshes 52 include the openings 54 of the above-mentioned size and the bottom faces 56 as described above.

Figure 6:
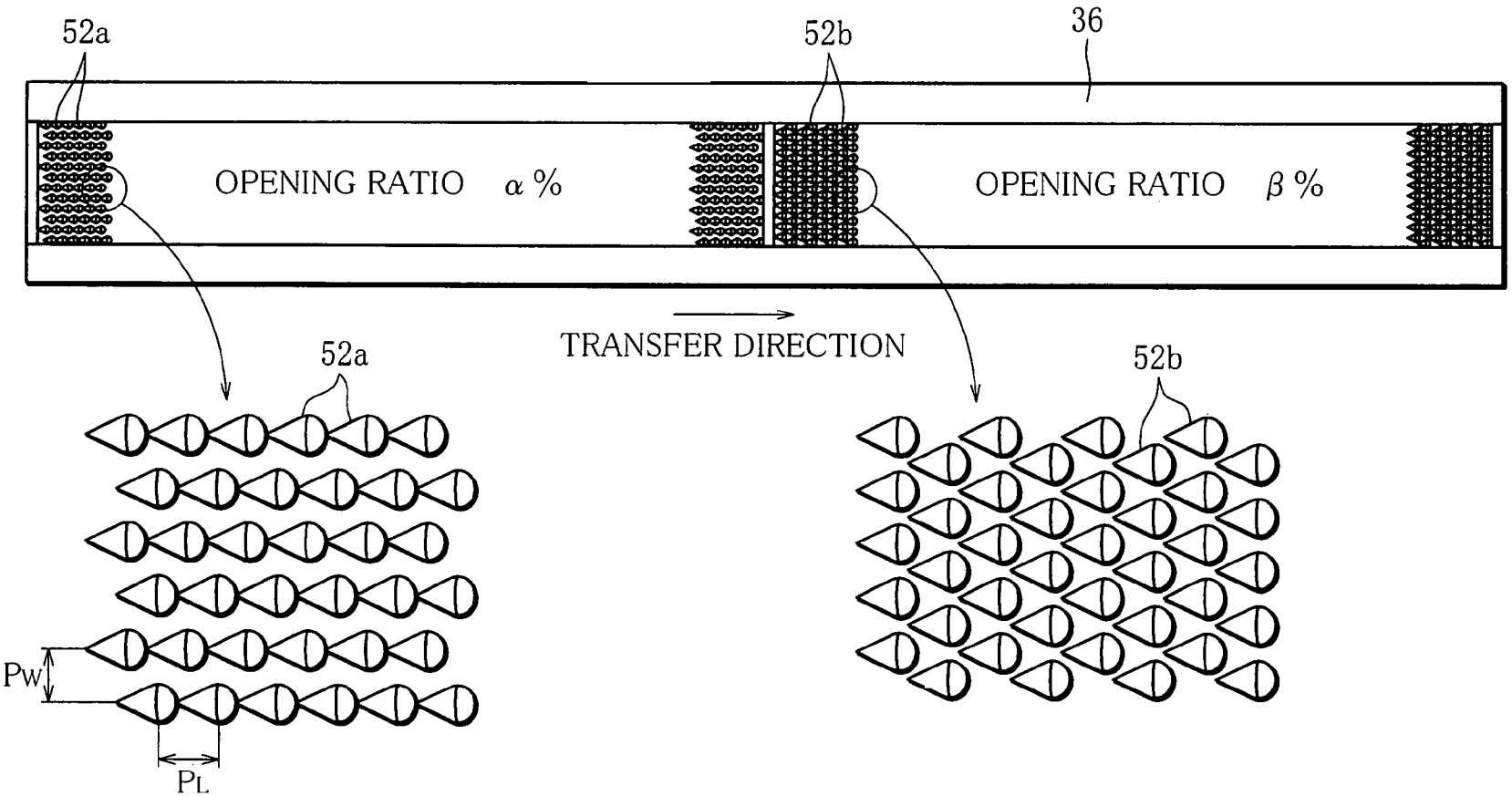
FIG. 6 is a plan view showing an oscillating sieve of a second embodiment.

FIG. 6 shows the oscillating sieve 36 of a second embodiment.

In the second embodiment, the sieve meshes 52 of the oscillating sieve 36 have uneven opening ratios. More concretely, when upstream and downstream sections of the oscillating sieve 36 have opening ratios $\alpha$ and $\beta$, respectively, the opening ratio $\beta$ is higher than the opening ratio $\alpha$. Therefore when the separation material is carried on the oscillating sieve 36, the medium particles that have not separated from the separation material in the upstream section of the oscillating sieve 36 and remained on the oscillating sieve 36 can smoothly pass through the sieve meshes 52 of the downstream section when reaching the downstream section of the oscillating sieve 36. Consequently, the oscillating sieve 36 of the second embodiment is capable of effectively separating the medium particles from the separation material. This reduces amount of the medium particles that are discharged into the collecting path 42 with the large particles, and then improves a usage rate of the shredded tobacco material.

Assuming that the sieve meshes 52 have an identical size, the opening ratio is obtained by the following expression:

$$\text{Opening ratio}(\%)=(S/(P_W \times P_L))\times 100$$

where S is the area of the oscillating sieve 36; $P_W$ is a pitch between the sieve meshes 52 located adjacent to each other in a width direction of the oscillating sieve 36 (the number of the sieve meshes 52 in the width direction); and $P_L$ is a feed pitch between the sieve meshes 52 located adjacent to each other in the transfer direction of the oscillating sieve 36 (the number of the sieve meshes 52 in the transfer direction).

In the oscillating sieve 36, the sieve meshes 52 of each line may be arranged in a zigzag pattern like sieve meshes 52*b* illustrated in FIG. 6, instead of being continuously aligned in the transfer direction.

The sieve conveyor 34 may have only the oscillating sieve 36, and a belt conveyor, instead of the oscillation transfer face 38, may be arranged under the sieve conveyor 34.

The invention claimed is:

1. A shredded tobacco material feeder of a cigarette manufacturing apparatus, comprising:

a feeding path for feeding shredded tobacco material toward a tobacco band of the cigarette manufacturing apparatus;

separation means for dividing the shredded tobacco material into normal particles having desired particle sizes and separation material having larger particle sizes than the normal particles in a feeding process of the shredded tobacco material; and a collecting path for receiving the separation material from said separation means, and transferring the separation material toward a central dust collector, wherein said separation means includes:

a sieve conveyor for receiving and transferring the separation material, said sieve conveyor dividing the separation material into large particles having large particle sizes and medium particles having smaller particle sizes than the large particles in a transfer process of the separation material, and returning the large particles to said collecting path;

a returning path for receiving the medium particles from the sieve conveyer, and returning the medium particles to said feeding path; and a separator interposed in said returning path, said separator dividing the medium particles into returnable components corresponding to the normal particles and collected components other than the returnable components, and discharging the collected components into said collecting path.

2. The feeder according to claim 1, wherein the said sieve having:

a sieve face; and a large number of sieve meshes distributed in the sieve face, the sieve meshes protruding from the sieve face, and having openings that face a direction of transferring the separation material and bottom faces that extend from the openings toward an upstream side in the transfer direction and are inclined downward.

3. The feeder according to claim 2, wherein said sieve conveyor includes a sieve and an oscillating source; and said oscillating source oscillates said sieve so that said sieve moves more slowly in backward speed than in forward speed as viewed in the direction of transferring the separation material.

4. The feeder according to claim 3, wherein said oscillating source has a pair of oscillating cylinders.

5. The feeder according to claim 2, wherein each of said sieve meshes has a raised portion for forming the opening, the raised portion being formed into a triangle that is tapered from the opening toward an upstream side in the transferring direction.

6. The feeder according to claim 5, wherein said sieve meshes are distributed to form a plurality of lines extending parallel to each other in the transfer direction, and adjacent lines of said sieve meshes are displaced from each other in terms of the transfer direction.

7. The feeder according to claim 6, wherein said sieve meshes of the same line are continuously arranged in the transfer direction.

8. The feeder according to claim 6, wherein said sieve further includes an upstream section and a downstream section as viewed in the transfer direction, the upstream and down stream sections having given opening ratios, respectively, wherein the opening ratio of the downstream section is higher than that of the upstream section.

9. The feeder according to claim 1, wherein said returning path is connected to said feeding path in the upstream of said separation means.

* * * * *